US009532662B2

(12) United States Patent
Desmond

(10) Patent No.: US 9,532,662 B2
(45) Date of Patent: Jan. 3, 2017

(54) SHELVING SYSTEM

(75) Inventor: Brett John Desmond, Doveton (AU)

(73) Assignee: Global Procurement Solutions Pty Ltd, New South Wales (AU)

( * ) Notice: Subject to any disclaimer, the term of this patent is extended or adjusted under 35 U.S.C. 154(b) by 0 days.

(21) Appl. No.: 13/139,654

(22) PCT Filed: Dec. 23, 2009
(Under 37 CFR 1.47)

(86) PCT No.: PCT/AU2009/001699
§ 371 (c)(1),
(2), (4) Date: Sep. 4, 2012

(87) PCT Pub. No.: WO2010/071943
PCT Pub. Date: Jul. 1, 2010

(65) Prior Publication Data

US 2013/0112640 A1 May 9, 2013

(30) Foreign Application Priority Data

Dec. 24, 2008 (AU) ..... 2008906648

(51) Int. Cl.
*A47F 5/00* (2006.01)
*A47B 96/02* (2006.01)
(Continued)

(52) U.S. Cl.
CPC ..... *A47F 5/00* (2013.01); *A47B 47/00* (2013.01); *A47B 57/58* (2013.01); *A47B 96/02* (2013.01);
(Continued)

(58) Field of Classification Search
CPC ..... A47F 5/00; A47F 5/0043; A47F 5/005; A47F 5/0068; A47B 47/00; A47B 57/58; A47B 96/02; A47B 96/021; A47B 65/00; G09F 3/204
(Continued)

(56) References Cited

U.S. PATENT DOCUMENTS 2,730,825 A 1/1956 Wilds
3,872,976 A 3/1975 Moore et al.
(Continued)

FOREIGN PATENT DOCUMENTS

EP 0 408 400 A1 1/1991
FR 2 869 779 A1 11/2005
(Continued)

OTHER PUBLICATIONS

International Search Report and Written Opinion for International Application No. PCT/AU2009/001699, mailed Mar. 18, 2010.
(Continued)

*Primary Examiner* — Joshua J Michener
*Assistant Examiner* — Devin Barnett
(74) *Attorney, Agent, or Firm* — Alston & Bird LLP

(57) ABSTRACT

The present invention relates to a shelf system or assembly, and a shelf module therefore. The shelf module defines a pair of substantially parallel, lengthwise extending edges and a pair of substantially parallel end edges, and comprises an array of lengthwise extending slats spaced apart across the width of the module, and an array of spaced apart ribs extending between these slats which are spaced apart along the length of the module, at least a pair of the slats having outwardly and oppositely directed partition retaining connection means at or toward an upper edge thereof, between which a portion of a partition can be secured. Each of an associated partition, display strip, shelf connector module
(Continued)

and shelf end module are also disclosed, where each of these is for removable attachment to the shelf module.

14 Claims, 8 Drawing Sheets

(51) Int. Cl.
*G09F 3/20* (2006.01)
*A47B 47/00* (2006.01)
*A47B 57/58* (2006.01)
*A47B 65/00* (2006.01)

(52) U.S. Cl.
CPC ..... *A47B 96/021* (2013.01); *A47F 5/005* (2013.01); *A47F 5/0043* (2013.01); *A47F 5/0068* (2013.01); *G09F 3/204* (2013.01); *A47B 65/00* (2013.01)

(58) Field of Classification Search
USPC ..... 108/65, 180–181, 185, 158.12; 211/184, 211/134, 59.2, 59.3, 175, 135, 189
See application file for complete search history.

(56) References Cited

U.S. PATENT DOCUMENTS 4,478,337 A 10/1984 Flum
4,901,869 A * 2/1990 Hawkinson et al. ..... 211/59.3
4,958,739 A * 9/1990 Spamer ..... 211/153
4,997,094 A * 3/1991 Spamer et al. ..... 211/153
5,024,336 A 6/1991 Spamer
5,088,607 A 2/1992 Risafi et al.
5,134,942 A 8/1992 Turnwald
5,199,584 A 4/1993 Fowler et al.
5,634,564 A * 6/1997 Spamer et al. ..... 211/59.3
5,638,963 A 6/1997 Finnelly et al.
5,685,664 A * 11/1997 Parham et al. ..... 403/393
6,082,556 A * 7/2000 Primiano et al. ..... 211/59.2
6,311,852 B1 11/2001 Ireland
6,695,152 B1 * 2/2004 Fabrizio et al. ..... 211/59.2
6,779,670 B2 * 8/2004 Primiano et al. ..... 211/74
6,962,260 B2 * 11/2005 Jay et al. ..... 211/59.2
2002/0108916 A1 * 8/2002 Nickerson ..... 211/59.3
2005/0092703 A1 * 5/2005 Mueller et al. ..... 211/59.3
2006/0049122 A1 * 3/2006 Mueller et al. ..... 211/59.3
2007/0029270 A1 2/2007 Hawkinson
2007/0138114 A1 * 6/2007 Dumontet ..... 211/59.3
2007/0251426 A1 11/2007 Li
2010/0252519 A1 * 10/2010 Hanners et al. ..... 211/184

FOREIGN PATENT DOCUMENTS

JP 2005-073898 A 3/2005
JP 2005-521504 A 7/2005
JP 2005-237706 A 9/2005
JP 3126771 U 11/2006
WO WO 03/084370 A2 10/2003

OTHER PUBLICATIONS

Further Examination Report for New Zealand IP No. 593212; dated Apr. 18. 2013.
Office Action for Chinese Application No. 200980152543.2; dated Apr. 11, 2013.
Office Action from Japanese Application No. 2011-542630, dated Feb. 18, 2014.
International Preliminary Report on Patentability for International Application No. PCT/AU2009/001699, dated Jun. 29, 2011.

* cited by examiner

SHELVING SYSTEM

FIELD OF THE INVENTION

This invention relates generally to a shelf system or assembly, and each of a shelf module, a partition and a display strip therefore.

More particularly, this invention relates to a gravity fed shelf system of the type used in retail displays where the shelf is sloped so that this is higher at the back than at the front thereof, this thereby causing products on the shelf to slide toward or to the forward edge thereof.

Known shelf systems of this type often utilise a plurality of longitudinally extending partitions which may be installed in selected locations (i.e. which are positionable), so as to accommodate products of various widths. These positionable partitions have been found to be wanting in terms of the stability offered thereby, and more particularly the lateral or sideways stability offered thereby. Also, it is desirable that the partitions are easily removed and repositioned to make rearrangement of a shelf layout easier by comparison to known systems.

Another problem with known shelf systems of this type is that the leading edge of the shelf or shelves represents a small area which is downwardly directed, and therefore less than ideal for positioning product and pricing information thereon.

It is an object of the present disclosure therefore to substantially ameliorate one or more of the above mentioned difficulties, or at least provide a shelf system and components therefore that are useful alternatives to known shelf systems of the above described type.

Other objects and advantages of the present invention will become apparent from the following description, taking in connection with the accompanying drawings, wherein, by way of illustration and example, an embodiment of the present invention is disclosed.

SUMMARY OF THE INVENTION

In one aspect of this invention there is proposed a shelf assembly or a kit of parts for a shelf assembly comprising a combination of a shelf module having a front edge, a partition adapted to be secured to the shelf module so as to extend in a direction that is substantially normal to the front edge of the shelf module, and a display strip adapted to be secured to the shelf module at or near the front edge thereof.

In a further aspect, the invention may include a shelf module for a shelf system. The shelf module is a strip having a pair of substantially parallel, lengthwise extending edges and a pair of substantially parallel end edges. One module may form a shelf in isolation, or a plurality of shelf modules may be employed and disposed side by side and connected along contiguous edges thereof to form a shelf of a desired width.

At least one end edge of the shelf module has an upstanding lip extending there along so as to form thereby a front edge of the shelf module. In one form, in an alternative, opposing ends of the module may have an upstanding lip extending there along, so that either of these ends may form a front edge of the shelf module.

A shelf module comprises an array of lengthwise extending slats spaced apart across the width of the module, and an array of spaced apart ribs extending between these slats along the length of the module. In one form, the slats sit proud of the ribs, so as to define a level above that of the ribs.

At least some of the slats having flange formations at or near an upper end thereof, each of the flange formations being separated from the flange formation on any adjacent slat. Slats having flange formations have an array of flange formations spaced apart lengthwise along the length of the slat.

A shelf module comprises end engagement means at or toward an end thereof that enable it to be connected to the end of another shelf module. In one form, these end engagement means are at or toward a rear end of the shelf module. In an alternative, there may be end engagement means at both ends of the shelf module.

A shelf module further comprises lateral engagement means along a lengthwise edge thereof, that enable it to be connected to a lengthwise edge of another shelf module.

In a further aspect, the invention may include a partition for a shelf system. The partition comprises a wall portion with a bottom edge and connection means at or near said bottom edge, said connection means being for securing the wall panel to a shelf module.

In one form, the connection means for the partition comprises a foot portion located at or near a lowermost edge of the wall portion. The foot portion is adapted to be secured between a pair of slats, and more particularly, a pair of adjacent slats, the foot of the partition interlocking with the flange formations of the pair.

The foot portion of the partition has a pair of opposing slots formed therein which are sized and adapted to receive the flanges of the slats. The partition may have an array of these foot portions spaced apart along its length. The spacing of theses foot portions would preferably correspond with the spacing of flange formations along a length of the slat of a shelf module.

It would be understood that the above described arrangement for connecting the partition to the shelf module may be reversed. That is the partition may have flange formations and the slats of the shelf module slots for receiving these flange formations.

In a further aspect, the invention may include a display strip for a shelf system, The display strip comprises a back portion adapted to be secured to the upstanding lip of the shelf module, and a wing intersecting the base portion such that these subtend an angle between them. In use, the wing will bear indicia such as product and pricing information.

In one form, the angle subtended by the portions of the display strip is equal to or greater than the angle of inclination of the shelf module to which the display strip is to be secured. In one form, the angle is an acute angle.

In one form, each of the shelf module, partition and display strip will be formed from a plastic material in a mold, although not necessarily the same mold, in a single plastic molding operation.

In a further aspect, the invention may include a shelf module for a shelf system comprising a pair of substantially parallel, lengthwise extending edges and a pair of substantially parallel end edges, an array of lengthwise extending slats spaced apart across the width of the module, and an array of spaced apart ribs extending between these slats along the length of the module, at least a pair of the slats having partition retaining connection means at or toward an upper edge thereof.

In a further aspect, the invention may include further separate and structurally distinct shelf modules which are adapted to be connected to the above described shelf module for the purpose of extending the length of this.

In a further aspect, the invention may include, in combination, two or more of the above described and structurally distinct shelf modules connected to each other so as to form a shelf.

In a further aspect, the invention may include a partition for a shelf system comprising a wall portion with a bottom edge and connection means at or near said bottom edge, said connection means being for securing the wall panel to a shelf module as described in the preceding paragraph.

In a further aspect, the invention may include, in combination, a shelf module as described above, and at least two partitions as described above, where said partitions are secured to the shelf module so as to be transversely separated from each other and define between them a travel path for products placed on the shelf and between the partitions.

In one form, this combination further includes a display strip as described above.

In a further aspect, the invention may include, in combination, a shelf module as described above, and a display strip as described above. In one form, this combination further includes at least two partitions as described above, where said partitions are secured to the shelf module so as to be transversely separated from each other and define between them a travel path for products placed on the shelf and between the partitions.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

The accompanying drawings, which are incorporated in and constitute a part of this specification, illustrate certain embodiments of the invention, and together with the description, serve to explain the principles of the invention.

Those skilled in the art will appreciate that the conception upon which this disclosure is based may readily be utilized as a basis for designing other structures, methods, and systems for carrying out the several purposes of the present invention. It is important, therefore, to recognise that the claims should be regarded as including such equivalent constructions insofar as they do not depart from the spirit and scope of the present invention.

BRIEF DESCRIPTION OF THE DRAWINGS

For a better understanding of this invention it will now be described with respect to an exemplary embodiment which shall be described herein with the assistance of drawings wherein.

In the following description, like reference characters designate like or corresponding parts throughout the several views of the drawings.

DETAILED DESCRIPTION

Figure 1:
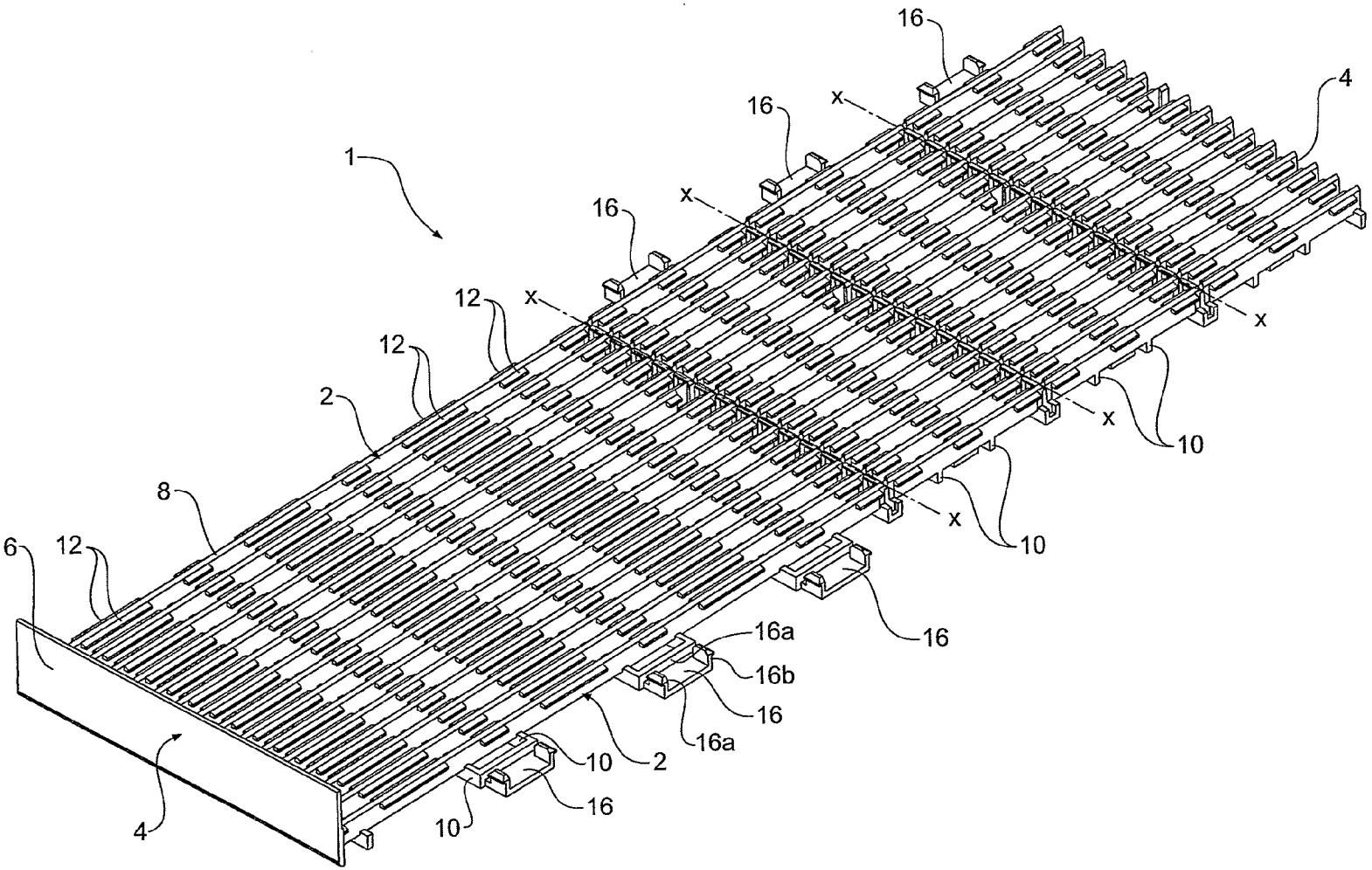
FIG. 1 is a perspective view of an exemplary shelf module.
Figure 2:
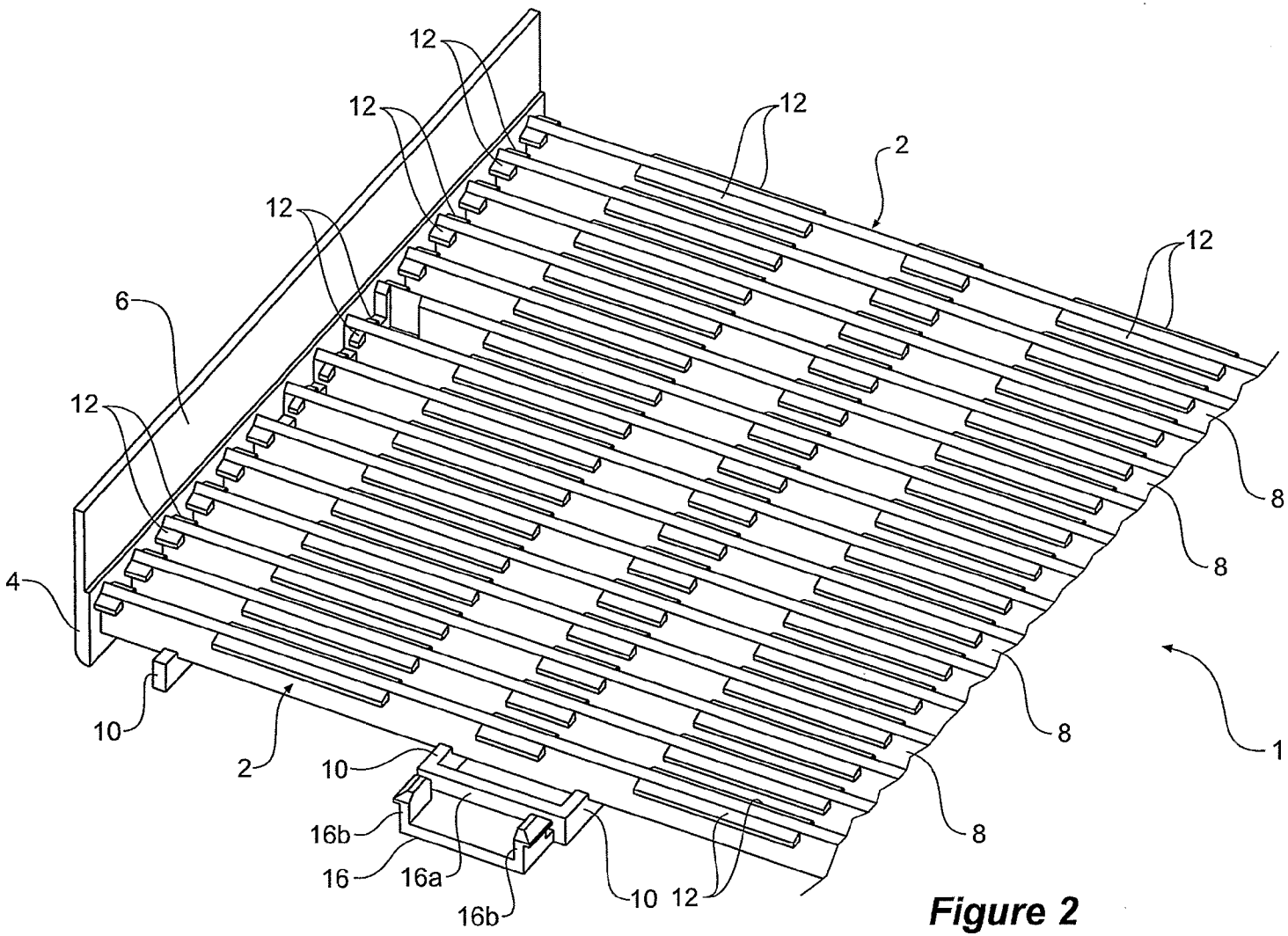
FIG. 2 is a detailed view of an end of the shelf module in FIG. 1.
Figure 3:
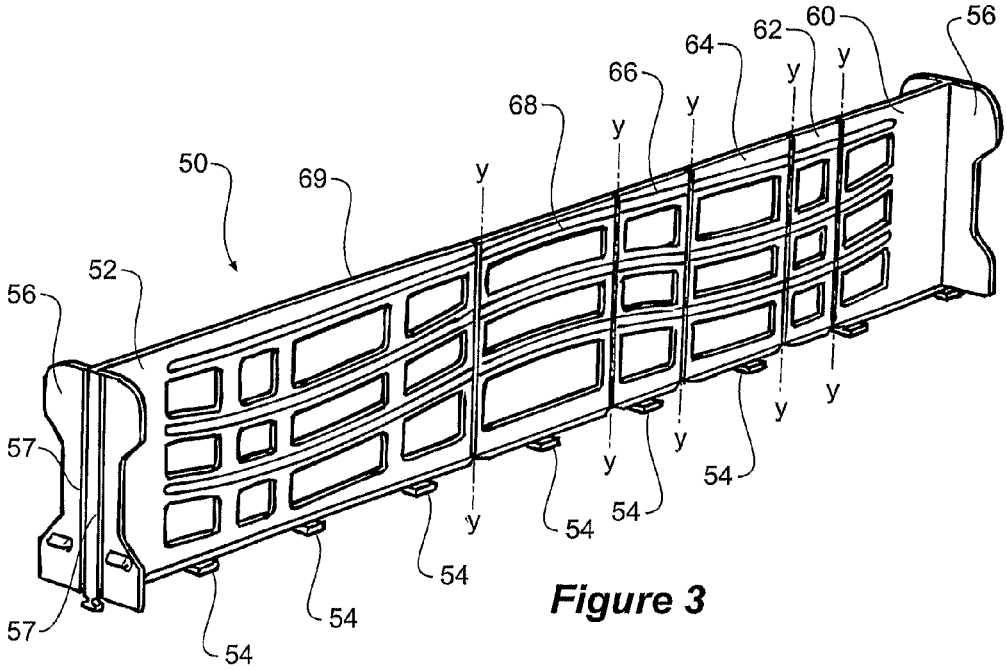
FIG. 3 is a perspective view of an exemplary partition for a shelf system employing the shelf module illustrated in FIGS. 1 and 2.
Figure 4:
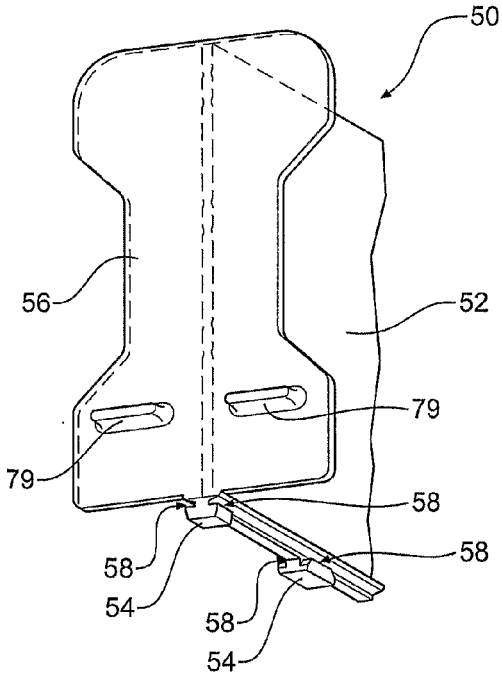
FIG. 4 is a detailed view of an end of the partition in FIG. 3.

Referring to FIG. 1, where there is illustrated a shelf module 1 for an exemplary shelf system. The shelf module 1 is a moulded plastic strip having a pair of substantially parallel, lengthwise extending edges 2 and a pair of substantially parallel end edges 4.

One end edge 4 of the shelf module has an upstanding lip 6 extending there along so as to form thereby a front edge of the shelf module 1.

The shelf module 1 is comprised of an array of lengthwise extending slats 8 spaced apart across the width of the shelf module 1, and an array of spaced apart ribs 10 extending between these slats 8 along the length of the shelf module 1, such that the slats 8 sit atop the ribs 10.

Each slat 8 has flange formations 12 at or near a free, uppermost end thereof. A flange formation 12 includes a pair of flanges, where one flange extends from each side of the slat 8. There are a plurality of these flange formations 12 spaced apart along the length of slat 8. Each of the flange formations 12 is separated (i.e. spaced apart) from the flange formations 12 on any adjacent slat 8.

Referring now to FIGS. 3 through 7, where there is illustrated a moulded plastic partition 50 for the exemplary shelf system. The partition 50 comprises a wall portion 52 and an integral array of foot portions 54 spaced apart along the length of the wall portion 52. The spacing of theses foot portions 54 correspond with the spacing of flange formations 12 along a slat 8 of the shelf module 1. These foot portions 54 are thicker than the wall portion 52 extending above them.

Both ends of the wall portion 52 have an end wall 56 extending transversely therefrom so that either end may serve as a front edge of the partition 50. In use then, stock placed in a chute defined between a pair of spaced apart wall partitions 50, will slide down the chute until it comes to rest against the end walls 56 of the spaced apart wall partitions 50.

Each foot portion 54 of the or each partition 50 has a pair of opposing slots 58 formed therein, which are sized and adapted to receive the flange formations 12 of the slats 8 therein.

In use then, a partition 50 can be securely but removably connected to a shelf module 1 by positioning its array of foot portions 54 in a position rearward of and below the mutually aligned array of flange formations 12 and sliding the partition forward into a position between the mutually aligned array of flange formations 12 of an adjacent pair of shelf member 1 slats 8 until the oppositely directed flange formations 12 snap fit into the opposing slots 58 in the foot portion 54.

An advantage of this system for connecting a partition 50 to a shelf module 1 is that the positioning of the partition 50 relative to the shelf module 1 can be quickly and easily changed, which is useful where spacing (i.e. chute width) between a pair of partitions 50 must be changed to accommodate a different sized product. It is also virtually impossible, given the design, for some of the foot portions 54 to locate in a different or adjoining pair of flange formations 12 thereby preventing unintentional misalignment of the partitions 50.

A further advantage of this connection is the high level of lateral or sideways stability imparted on the partition 50 by virtue of its positive capture between the flange formations 12 of a pair of adjacent shelf member 1 slats 8. As a result, a wall partition 50 can support relatively heavy product and/or product having a high centre of gravity, without collapsing.

The wall partition 50 further comprises a breakaway back section 60 and an interconnected series of breakaway intermediate sections 62, 64, 66 and 68 connecting the front section 69 (which is characterised by being the longest section of partition 50) and back 60 sections. The breakaway feature is typically implemented by providing a line of weakness shown at YY, which extends through the partition 50 transverse to its direction of elongation. Breaking away one or more of these breakaway sections 60 through 68 allows the length of the partition 50 to be adjusted to suit. Pairs of adjacent lines of weakness are provided which allows for either end of the partition 50 to be placed at the front of the shelf module 1.

The end wall 56 has two lines of weakness 57 which enable one side of the end wall 56 to be removed if required. This may be necessary when the partition 50 is located near or abuts against a side wall or other structural feature of a cabinet within which the shelf module 1 is used.

Figure 6:
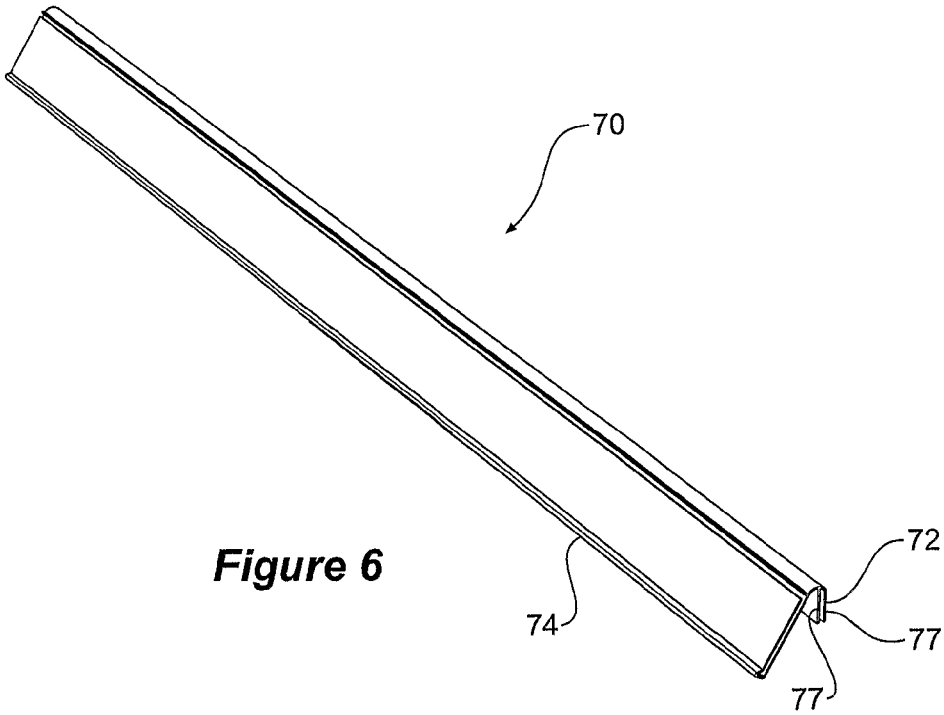
FIG. 6 is a perspective view of an exemplary display strip for a shelf system employing the shelf module illustrated in FIGS. 1 and 2.
Figure 7:
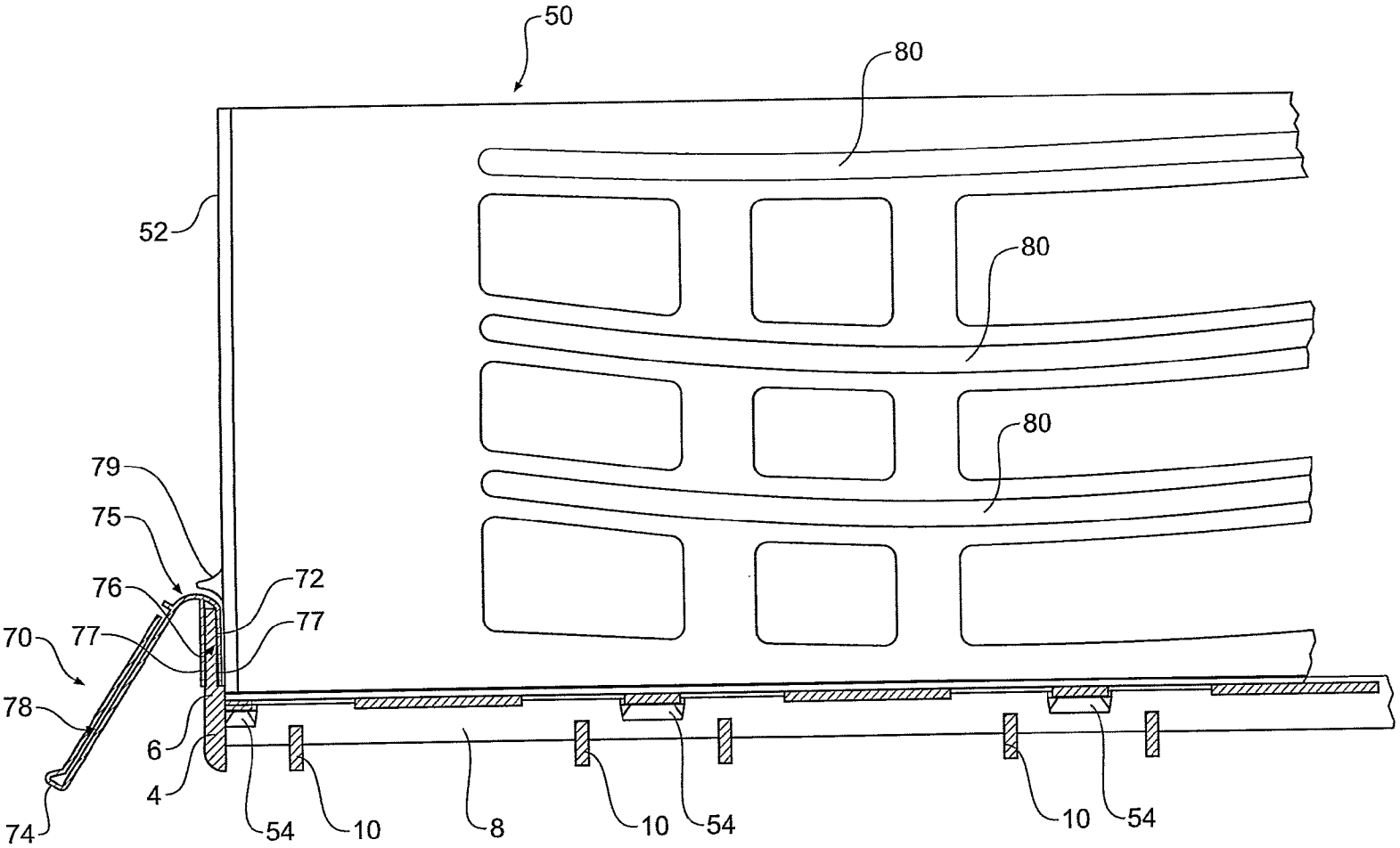
FIG. 7 is a partial cross-sectional view taken along the shelf module in FIGS. 1 and 2, showing the partition in FIGS. 3 and 4 and the display strip of FIG. 6 secured thereto.

Referring now to FIGS. 6 and 7, where there is illustrated a moulded plastic display strip 70 for the exemplary shelf system. The display strip 70 comprises a back portion 72 adapted to be securely but removably secured to the upstanding lip 6 of the shelf module 1, and a wing 74 intersecting the base portion 72 such that these subtend an acute angle between them. In use, the wing 74 will bear indicia such as product and pricing information.

The back portion 72 of the display strip 70 defines a channel 76 between a pair of legs 77. The channel 76 is sized to be disposed upon the upstanding lip 6 of the shelf module 1 with a secure fit. The upper edge 75 of the display strip 70 locates under projections 79 on the end of wall 56 of the partition 50. This prevents inadvertent dislodgment of the display strip 70.

Where the display strip 70 is moulded from a transparent plastic, the wing 74 defines a slot 78 into which printed materials bearing promotional and/or pricing information can be inserted for display.

A significant advantage of this exemplary display strip 70 is that the front surface of the wing 74 is presented at an angle which is well suited for making product and pricing information visible to a consumer.

A further advantage is that the product and pricing information can be easily changed by replacing one printed strip located within the slot 78 with another. Alternatively, where product and pricing information has been printed on a sticker which has been in turn applied to the wing 74 of the display strip 70, the entire display strip 70 can be quickly and easily moved and replaced as appropriate, eliminating the need to remove the sticker from the display strip 70. This is also advantageous where pricing changes.

In use, a plurality of shelf modules 1 may be employed and disposed side by side and connected along contiguous edges 2 thereof (using the lateral engagement means 16 thereof) to form a display shelf (the mechanism via which they may be connected will be discussed in greater detail below). A plurality of partitions 50 may then be connected to the shelf in the manner described above so that there is an array of spaced apart partitions 50 extending lengthwise along the shelf. These partitions 50 define between them chutes in which stock can be positioned ready for sale.

The display shelf should be of sufficient depth (that is, the length from the front thereof to the back thereof) that the entire depth of the support surface (i.e., the counter, table top or refrigeration tray) is occupied by the shelf with no wasted space. If the display shelf does not occupy the full depth, objects placed on the support surface in front of the display shelf will conceal the products intended to be displayed on the display shelf, while objects placed on the support surface behind the display shelf will be at least partially hidden from customer view and not readily accessible to a potential customer.

Figure 5:
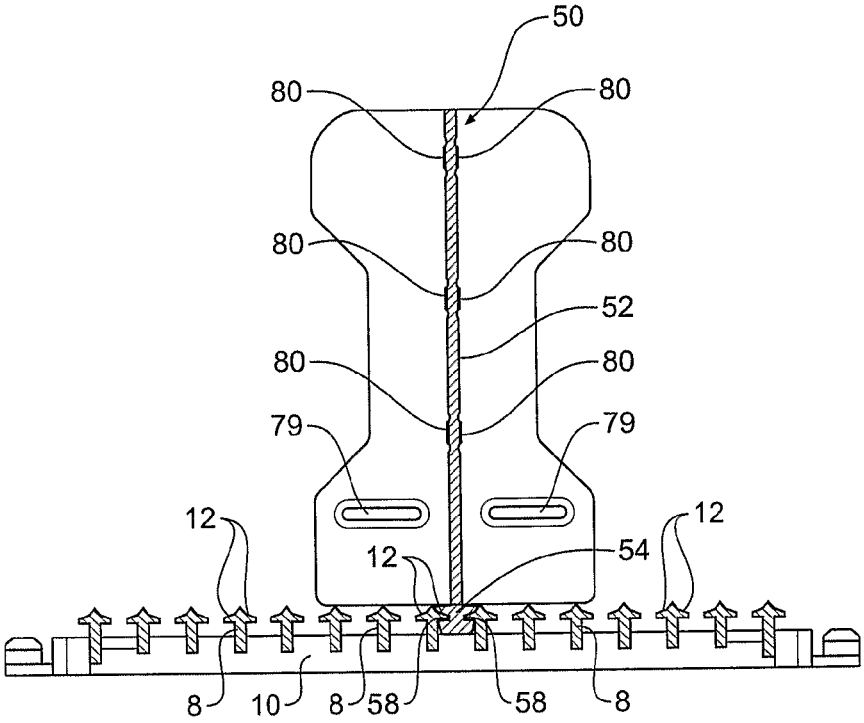
FIG. 5 is a partial cross-sectional view taken across the shelf module in FIGS. 1 and 2, showing the partition in FIGS. 3 and 4 secured thereto.

Referring to FIGS. 5 and 7, the side walls of the partitions 50 have three raised ridges 80 on each side of the partitions 50. The products located on the shelf modules 1 between each partition 50 abut only against the ridges 80. This results in reduced contact with the product containers which in turn reduces the sliding friction between the partitions 50 and product.

Referring again to the shelf module 1 then, which further comprises a front section 100 (which is characterised by being the longest section of shelf module 1), a breakaway back section 102, and an interconnected series of breakaway intermediate sections 104, 106 and 108 connecting the front 100 and back 102 sections.

The back section 102 has a conventional breakaway feature which enables this to be separated from the immediately forward section 108. The breakaway feature is typically implemented by providing a plane of weakness extending through the shelf module transverse to the major longitudinal dimension of the module 1. This breakaway back feature is conventional in nature and hence need not be described herein in further detail. The interconnected series of intermediate sections 104, 106 and 108 connecting the front 100 and back sections 102 also include a breakaway feature, allowing each of the intermediate sections to be broken-away, either individually and successively or as one or more groups of intermediate sections as required.

The breakaway back section 102 comprises end engagement means 15 in the form of a female connector portion at the rear end thereof, said engagement means 15 enabling a further shelf connector module 200 to be connected via a male connector portion 202 attached thereto.

Figure 8:
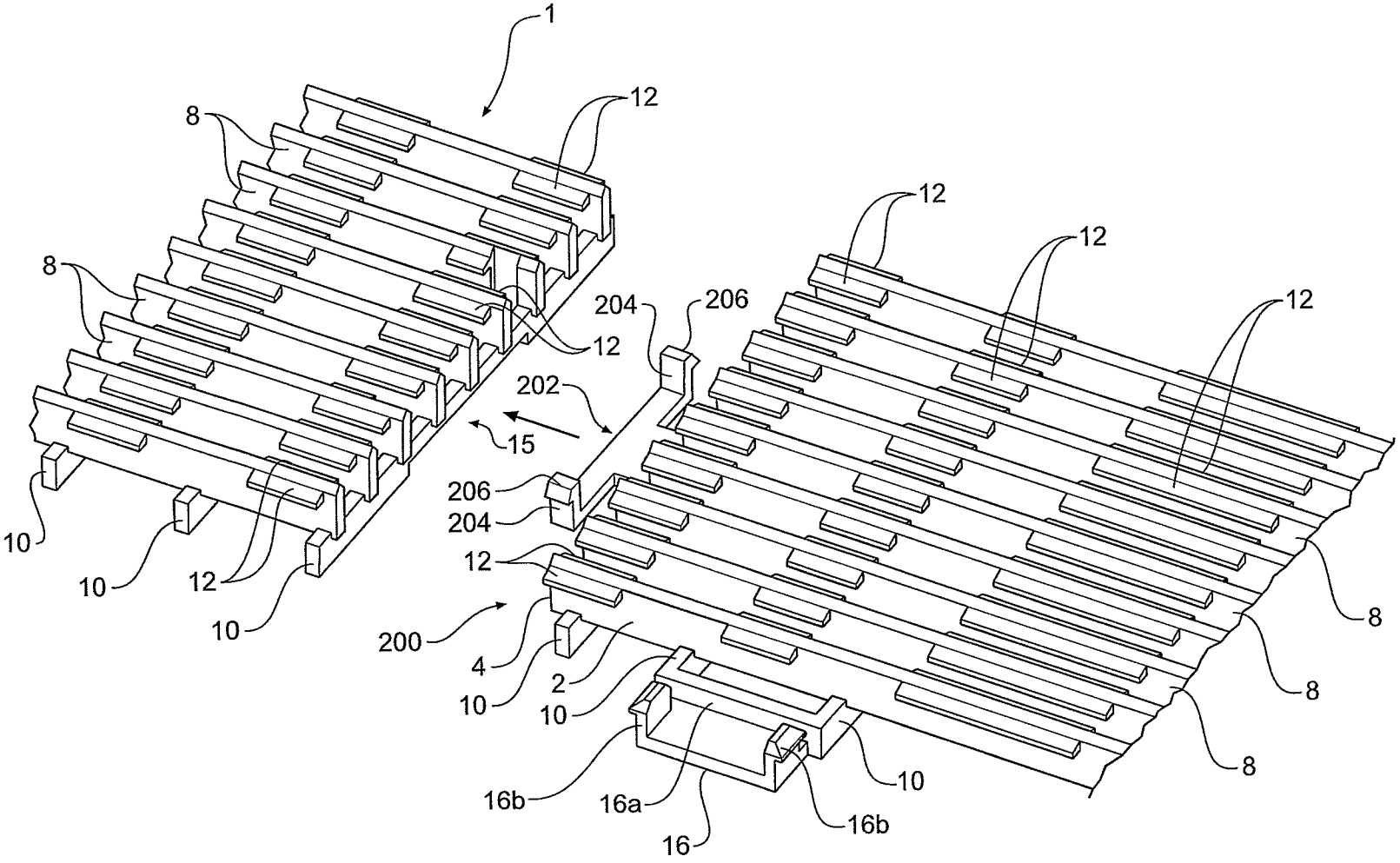
FIG. 8 is a detail view illustrating the connecting end portions of the shelf module in FIGS. 1 and 2 and a shelf connector module.
Figure 9:
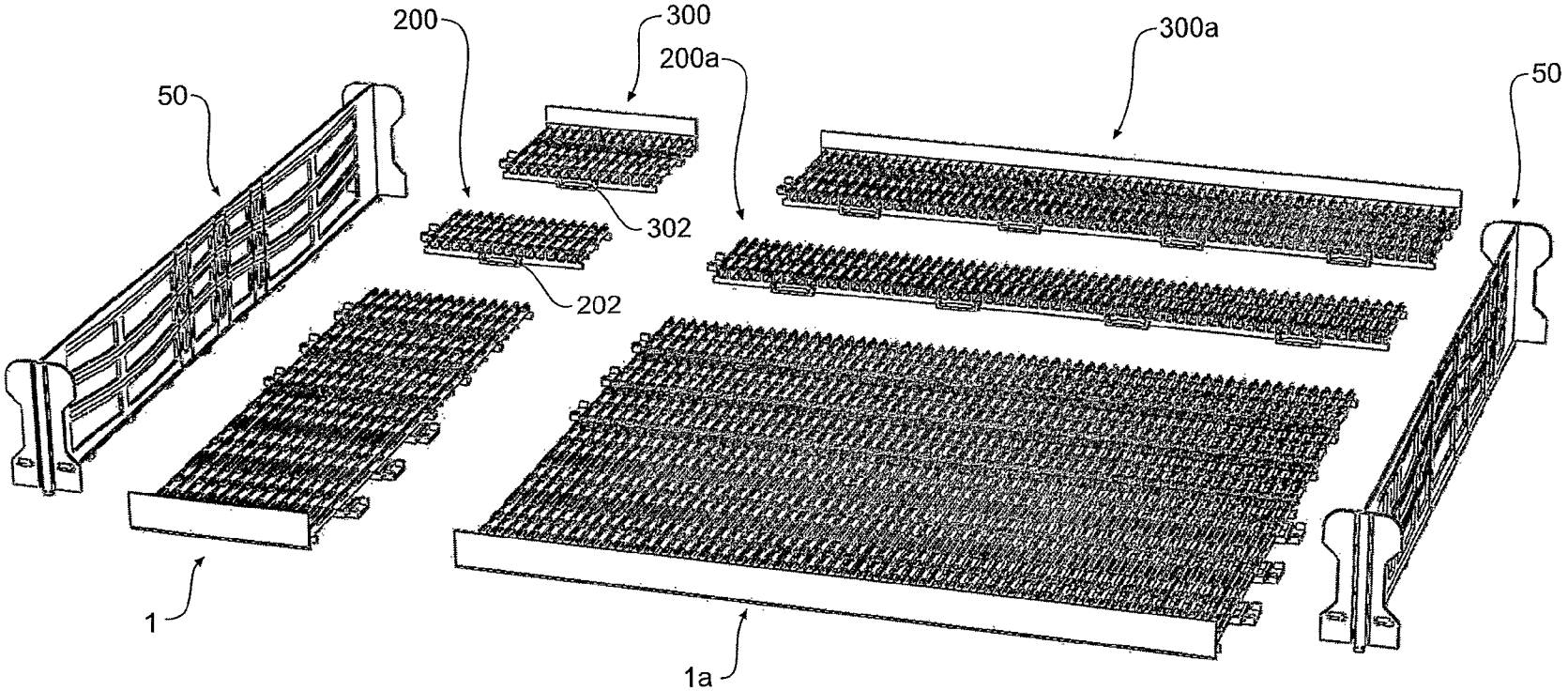
FIG. 9 is perspective view of a number of parts which may comprise a shelf assembly or a kit of parts therefore.

Referring now to FIGS. 8 and 9 then, where there is illustrated a shelf connector module 200. This shelf connector module is a separate and distinct part to shelf module 1. The shelf connector module 200 is of almost identical construction to shelf module 1, with the exception that in place of upstanding lip 6, the shelf connector module has male end connector portions 202 adapted for connection with the female end connector portions 15 of shelf module 1 (and it is shorter than shelf module 1).

Referring again to FIG. 9, where there is illustrated a shelf end module 300. This shelf end module 300 is a separate and distinct part to both shelf module 1 and the shelf connector module 200. The shelf end module 300 is of almost identical construction to shelf module 1, with the exception that in place of female end connector portions 15 in one end thereof the shelf end module 300 has male connector portions 302 the same as the shelf connector module 200 (and it is shorter than shelf module 1, but longer than shelf connector module 200).

In this exemplary embodiment, the male end connector portions 202 and 302 comprise a pair of upwardly directed prongs 204 having oppositely directed barbed ends 206, which are intended for insertion from beneath and between a pair of ribs 10 of either of an unbroken end of a shelf module 1 or a broken end of an intermediate section 104, 106 or 108 thereof. Selected pairs of ribs 10 of the shelf module 1 are specially adapted to accept this male end connector portion 202 or 302 there between by way of having an undercut formed therein which is sized so as to capture the oppositely directed barbed ends 206 therein. The rear edge 4 of the module extending between these specially adapted ribs 10 is also recessed so as to provide access for the male end connector portions 202 and 302.

A broken end of an intermediate section 104, 106 or 108 is formed when a breakaway section (i.e. any one of sections 102 through 108) of a shelf module 1 is removed from the shelf module 1. The removal of any of the breakaway sections permits access to a female end connector portion 15 which is adapted to receive a male end connector portion 202 or 302.

In this way then a shelf strip of a desired length can be formed from a shelf module 1, or a combination of a shelf module 1, a plurality of shelf connector modules 200, and (optionally) a shelf end module 300.

Where the required shelf strip is shorter than the shelf module 1, it may be sufficient to merely break off the portions of the shelf module 1 that are not required. Where the required shelf strip is longer than the shelf module 1, one or more shelf connector modules 200 can be added to the length of the first shelf module 1, and the shelf strip finished with a shelf end module 300 if desired.

Figure 10:
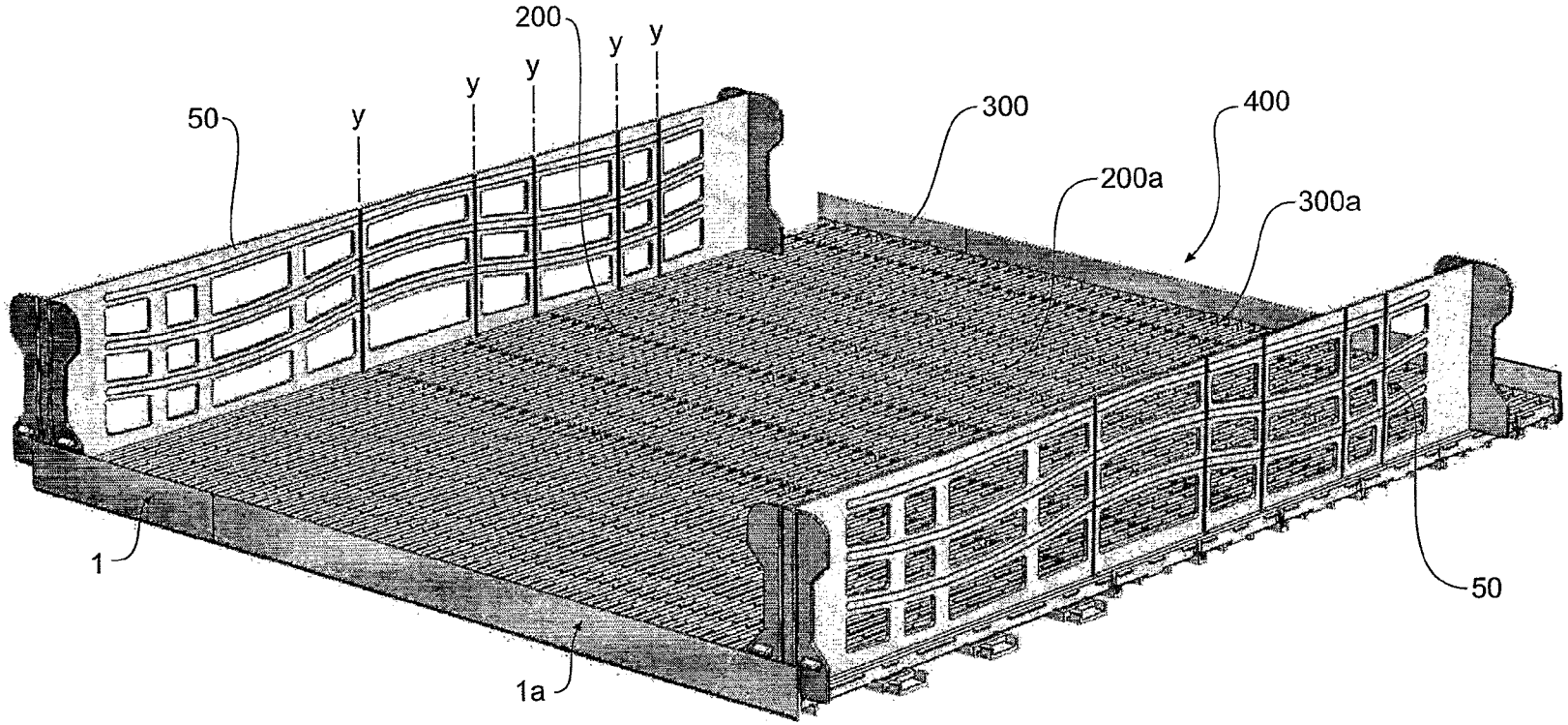
FIG. 10 is a perspective view of an assembled shelf assembly.

With reference to FIG. 10, where two or more shelf strips comprise the shelf display, these should be assembled to the desired length using the above described technique, and then connected along contiguous edges 2 thereof to form a display shelf 400. To enable this contiguous connection, the shelf module 1 further comprises an array of spaced apart lateral engagement means 16 along a lengthwise edge 2 thereof, that enable it to be connected to a lengthwise edge 2 of another shelf module 1.

Similarly, shelf connector module 200 and shelf end module 300 each comprises at least one of these lateral engagement means 16.

In this exemplary embodiment, these lateral engagement means 16 comprise a bridging element 16*a* extending between a pair of slats 8, and a male connector portion 16*b* extending from this bridging member.

These male lateral connector portions 16*b* comprise a pair of upwardly directed prongs having oppositely directed barbed ends (much like male end connector portions 202), which are intended for insertion from beneath and between a pair of slats 8 of a lengthwise edge (or side) 2 of a shelf module 1. Selected pairs of slats 8 of the shelf module 1 are specially adapted to accept this male lateral connector portion 16*b* there between by way of being spaced apart a matching distance (i.e. matching the spacing of the upwardly directed prongs having oppositely directed barbed ends).

An advantage of lateral connection means 16 of the above described type is the rigid, secure connection created between shelf strips 1 and/or modules 200 and 300.

With reference to FIG. 9, it can be see that shelf module 1, shelf connector module 200 and shelf end module 300 may be made in varying widths as at 1*a*, 200*a* and 300*a*, all of which are considerably wider that 1, 200 and 300 respectively. It is considered that shelf module components 1, 1*a*, 200, 200*a*, 300 and 300*a* as illustrated in FIG. 9 should permit the construction of a shelf assembly which is perfectly sized and suited for any point of sale application.

When one or more partitions 50 and display strips 70 are secured to display shelf 400 a functional and aesthetically pleasing shelf assembly is created.

It will be understood that the term "comprise" and any of its derivatives (e.g. comprises, comprising) as used in this specification is to be taken to be inclusive of features to which it refers, and is not meant to exclude the presence of any additional features unless otherwise stated or implied.

The reference to any prior art in this specification is not, and should not be taken as an acknowledgement of any form of suggestion that such prior art forms part of the common general knowledge.

Although the disclosure has been herein shown and described in what is conceived to be the most practical and preferred embodiment, it is recognized that departures can be made within the scope of the invention, which is not to be limited to the details described herein but is to be accorded the full scope of ay appended claims so as to embrace any and all equivalent devices and apparatus.

The invention claimed is:

1. A shelf system comprising a shelf module having a length and a width and a partition, the shelf module defining a pair of substantially parallel lengthwise extending edges, a pair of substantially parallel end edges, and an array of lengthwise extending slats spaced apart across the width of the module, an array of ribs extending between each slat so as to be spaced apart along the length of the module, wherein at least a portion of each of the slats extends above an upper edge of the ribs, so as to define a support surface above the ribs, wherein the support surface is configured to support objects thereon, wherein at least a pair of adjacent slats of the array of lengthwise extending slats comprises an array of outwardly and oppositely directed flange formations at an upper edge thereof and the flange formations are each spaced apart lengthwise along a length of the corresponding pair of slats by flangeless slat portions, the partition comprising a length and a wall portion with a bottom edge and an array of foot portions extending downwardly from the bottom edge of the wall portion, wherein each of the foot portions are spaced apart lengthwise along the length of the partition by portions of the wall portion that have no foot portions, wherein opposing slots are formed between a bottom of each foot portion and the wall portion of the partition, wherein the slots are sized and configured to receive corresponding flanges formations on the corresponding pair of slats for cooperative but removable securement with the flange formations of each of the corresponding pair of adjacent slats, so that the secured partition extends lengthwise along the shelf module; wherein in use, the partition is configured to be secured to the shelf module by inserting each foot portion of the partition between the flangeless slat portions, and then moving the partition longitudinally until the cooperative but removable securement of the foot portions and the flange formations is effected.

2. The shelf system according to claim 1, wherein each flange formation on a first slat from the corresponding pair of slats is separated from the corresponding flange formations on a second slat from the corresponding pair of slats.

3. The shelf system according to claim 1, wherein at least one end edge of the shelf module has an upstanding lip extending there along so as to form thereby a front edge of the shelf module.

4. The shelf system according to claim 1, wherein the shelf module comprises end connector at a rear edge of the shelf module.

5. The shelf system according to claim 1, wherein the shelf module comprises lateral connectors along the lengthwise edges of the shelf module, which enable the shelf module to be connected to a lengthwise edge of another shelf module.

6. The shelf system according to claim 5, wherein the lateral connectors on one lateral edge of the shelf module are male connectors, and lateral connectors on the other lateral edge are male connectors.

7. The shelf system according to claim 1, wherein the shelf module is divided lengthwise into at least two sections by a plane of weakness extending through the module, so that in use, the sections can be separated at the plane of weakness.

8. The shelf system according to claim 1, wherein the shelf module is divided lengthwise into four sections by three planes of weakness, so that in use, the corresponding sections can be separated at the corresponding planes of weakness.

9. The shelf system according to claim 1, wherein the spacing of the foot portions corresponds with the spacing of the corresponding flange formations along the corresponding pair of slats of the shelf module.

10. The shelf system according to claim 1, wherein each foot portion of the partition interlocks with corresponding pairs of flange formations extending between the corresponding pair of slats that retain the corresponding foot portions.

11. The shelf system according to claim 1, wherein the partition is divided lengthwise into at least two sections by a line of weakness extending through the partition, so that in use, the sections can be separated at the plane of weakness.

12. The shelf system according to claim 1, wherein the partition is divided lengthwise into five sections by four lines of weakness extending through the partition, so that in use, the sections can each be separated at the corresponding planes of weakness.

13. The shelving system according to claim 1, wherein said partition is a first partition, wherein a second partition is removably secured to the shelf module, so as to be transversely spaced apart from the first partition to define between them a travel path for products placed on the shelf module between the partitions.

14. The shelf system of claim 5, wherein at least two shelf modules are connected along their respective lengthwise edges.

* * * * *